United States Patent [19]

Carolan, Jr.

[11] Patent Number: 4,596,391

[45] Date of Patent: Jun. 24, 1986

[54] PORTABLE GOLF GAME

[76] Inventor: Leo P. Carolan, Jr., Box 144, Lester, Iowa 51242

[21] Appl. No.: 794,269

[22] Filed: Nov. 1, 1985

[51] Int. Cl.[4] ..... A63B 67/02

[52] U.S. Cl. ..... 273/176 B; 273/176 FB; 273/178 B; 273/87 C

[58] Field of Search ..... 273/176 R, 176 AB, 176 B, 273/176 F, 176 FB, 176 J, 178 B, 87 R, 87 C, 87.2

[56] References Cited

U.S. PATENT DOCUMENTS

| | | | |
|---|---|---|---|
| 1,548,291 | 8/1925 | Van Arsdale, Jr. | 273/87.2 |
| 1,582,237 | 4/1926 | Angell | 273/87.2 X |
| 1,606,911 | 11/1926 | Winbigler | 273/87.2 |
| 1,679,374 | 8/1928 | Rearden | 273/178 B |
| 1,856,816 | 5/1932 | Luddy | 273/176 F |
| 1,864,500 | 6/1932 | Livingston et al. | 273/87.2 |
| 2,176,622 | 10/1939 | Davis | 273/176 F |
| 2,827,299 | 3/1958 | Dean | 273/176 F |
| 2,995,372 | 8/1961 | Hines | 273/87 R |
| 3,801,101 | 4/1974 | Greenberg | 273/87.2 |
| 3,861,524 | 1/1975 | Coleman | 273/176 FB |
| 3,868,111 | 2/1975 | Schuelke | 273/87 C |
| 3,892,405 | 7/1975 | Trevino | 273/87.2 |
| 3,897,067 | 7/1975 | Smith | 273/176 G |
| 3,944,232 | 3/1976 | Tierney | 273/176 FB |
| 4,098,507 | 7/1978 | Hudon | 273/87 C |

FOREIGN PATENT DOCUMENTS

| | | | |
|---|---|---|---|
| 676900 | 11/1964 | Italy | 273/176 F |

*Primary Examiner*—William H. Grieb

*Attorney, Agent, or Firm*—Haverstock, Garrett and Roberts

[57] ABSTRACT

A portable golf game for use with a standard golf club, such as a putter, and standard golf balls having a substantially planar playing surface formed of a plurality of segment portions, one end of said playing surface having a location thereon for placement of a cup for receiving golf balls, walls extending substantially normal to the playing surface located partly around the edge thereof, predetermined locations indicated on portions of the playing surface, at least one obstacle member for placement on said playing surface at the predetermined locations which obstacle increases the difficulty of play, at least two of the playing surface segment portions being selectively joinable to form a container for the containment of the other segment portions and the obstacle members.

1 Claim, 5 Drawing Figures

PORTABLE GOLF GAME

This is a continuation of co-pending application Ser. No. 633,579 filed on July 23, 1984 now abandoned.

SUMMARY OF THE INVENTION

The present invention relates generally to a portable golf game for use wih a standard golf club and a standard golf ball. The present game may be played by experienced and inexperienced golfers alike and is useful in improving golf skills as well as providing entertainment. More specifically, the device comprises a substantially planar playing surface formed of a plurality of surface segments which segments may be collocated and placed into a container for storage and transportation. The container is formed of at least two of the segments. When the surface segments are assembled for play, as by placing them on a floor abutting each other, they form a contiguous playing surface with a wall at least partially around the greens area and fairway for confinement of the golf ball during play.

The greens area has a substantially normal wall extending around the greens area except for an opening through which a golf ball may pass during the playing of the game. When assembled for play, the greens area has placed thereon a golf ball receiving cup. The golf ball receiving cup may be any type of ball receiving cup such as is available for practice putting. The cup may be placed anywhere on the greens area in order to change the difficulty of the game.

The obstacle placement segments, which have substantially normal extending wall portions on two opposing edges thereof, have marked thereon locations for the placement of obstacle members. The obstacle placement segments thus have walls along the sides with openings at either end. When at least one obstacle placement segment is placed adjacent the greens area with one of the end openings in registration with the opening of the greens area, the obstacle placement segment forms a passageway or fairway through which a golf ball may be projected toward and onto the greens area by striking with a golf club. Additional obstacle placement segments can be used to lengthen the fairway which obstacle placement segments can be formed so that they may be affixed to one another when collocated and thereby form a container for the containment and transportation of the game parts.

One or more obstacle members is selectively placed on the obstacle placement segments at predetermined locations marked on the playing surface of the obstacle segments. The obstacles may cause interference with the movement of the golf ball toward the greens area by blocking predetermined portions of the fairway and the marked obstacle placement locations are so located as to add different degrees of difficulty to the game as the game progresses.

The obstacle members of the present device are to be placed on the playing surface of the obstacle placement segments at the predetermined marked locations so that they serve to obstruct part of the playing surface to increase the difficulty in getting the ball into the cup such as by narrowing the pathway through which the ball must pass to reach the cup. The obstacles are placed on the playing surface in a relatively rigid but movable position so that when a ball strikes them, they tend to remain in place but may move thereby changing the obstacle's location and the difficulty of the hole when a poor shot has been made.

The fairway segments are planar portions with a playing surface thereon and do not require wall members around the edges thereof. Alternately, the fairway may be a continuous strip of playing surface material which may be rolled or folded for storage. The fairway segments are to be placed adjacent the obstacle placement segment abutting the open end thereof and a golf ball placed on the playing surface in order to begin each hole of the present game. The length of the fairway may be extended as by adding additional segments to make it a more challenging fairway.

Once the game is assembled for play, as by abutting the various game segments with the walls therearound as described above, and the obstacles and ball receiving cup put into place, the ball is placed on the tee and struck by the golf club toward the cup in the traditional manner. A putter type golf club is preferably used but other types of clubs may also be used. The object of the game is to move the golf ball down the fairway, past the obstacles and into the cup in the fewest possible strokes. This defines a "hole". After each "hole" is played and the other players have played that "hole", the obstacle members are moved to different predetermined locations marked on the obstacle segments, thereby forming a new "hole" to be played. Ideally, eighteen numbered obstacle locations for each obstacle member are marked on the obstacle segments corresponding to eighteen "holes" of golf, with each "hole" having a different level of difficulty. At least one obstacle is always used and two or more may be used to increase the difficulty of play as the game progresses.

When the present device is not in use it may be disassembled and packed into a compact container. The obstacle placement segments may be joined to form the compact container into which the fairway segments, the greens segments, the obstacle members and the ball receiving cup are placed for storage and transportation. Thereafter, the compact container formed by portions of the present device and having the other game portions therein may be easily carried to a new location by the use of a handle attached to one of the obstacle segments or it may be stored in a convenient storage location such as a cabinet or closet.

Prior Art

U.S. Pat. No. 3,801,101 discloses a portable simulated golf game wherein the object is to propel a miniature golf ball into a trough equipped cup and which device includes hazards attached to the playing surface by retaining pins.

U.S. Pat. No. 4,098,507 discloses a portable miniature golf game in the shape of a cross which has at least two ball receiving cups and arcuate shaped ball rises and which may also include various shaped ball deflectors secured to the playing surface, as well as a fortune wheel.

U.S. Pat. No. 3,868,111 discloses a platform miniature golf game with a plurality of adjacent simulated fairways for use with a ball the size of a marble and a comparably sized club. The device may also include bridges, tunnels and transversely extending walls with openings which are fixed to the playing surface.

U.S. Pat. No. 2,827,299 discloses a miniature golf game formed by barrier members which are connected to each other and placed on a carpet.

U.S. Pat. No. 3,897,067 discloses a portable golf game with at least three separate fairways connected by hinges which may be supported by retractable legs.

U.S. Pat. No. 3,892,405, U.S. Pat. No. 1,548,291, U.S. Pat. No. 1,582,237, U.S. Pat. No. 1,606,911, U.S. Pat. No. 1,864,500 and U.S. Pat. No. 2,995,372 all disclose portable golf games. None of these patents disclose or suggest the invention disclosed and claimed herein.

Objects

A principal object of the present invention is to make a portable golf game for use with standard golf balls and clubs.

One object of the present invention is to make a portable golf game which may be packed into a relatively small container.

Another object is to make a portable golf game for use indoors or outdoors.

Another object is to make a portable golf game which is simple to assemble and disassemble.

Another object is to make a golf game which offers many different levels of difficulty of play.

Another object is to make a golf game which allows for the placing of obstacles at different locations.

Another object is to make a portable golf game wherein a portion of the playing surface forms a storage container for the game.

Another object is to make a portable golf game which may be used by golfers of all skill levels.

BRIEF DESCRIPTION OF THE DRAWINGS

These and other objects and advantages of the present invention will become apparent to those skilled in the art after considering the following detailed specification of a preferred embodiment of the present device in conjunction with the accompanying drawings, wherein.

DESCRIPTION OF A PREFERRED EMBODIMENT

Figure 1:
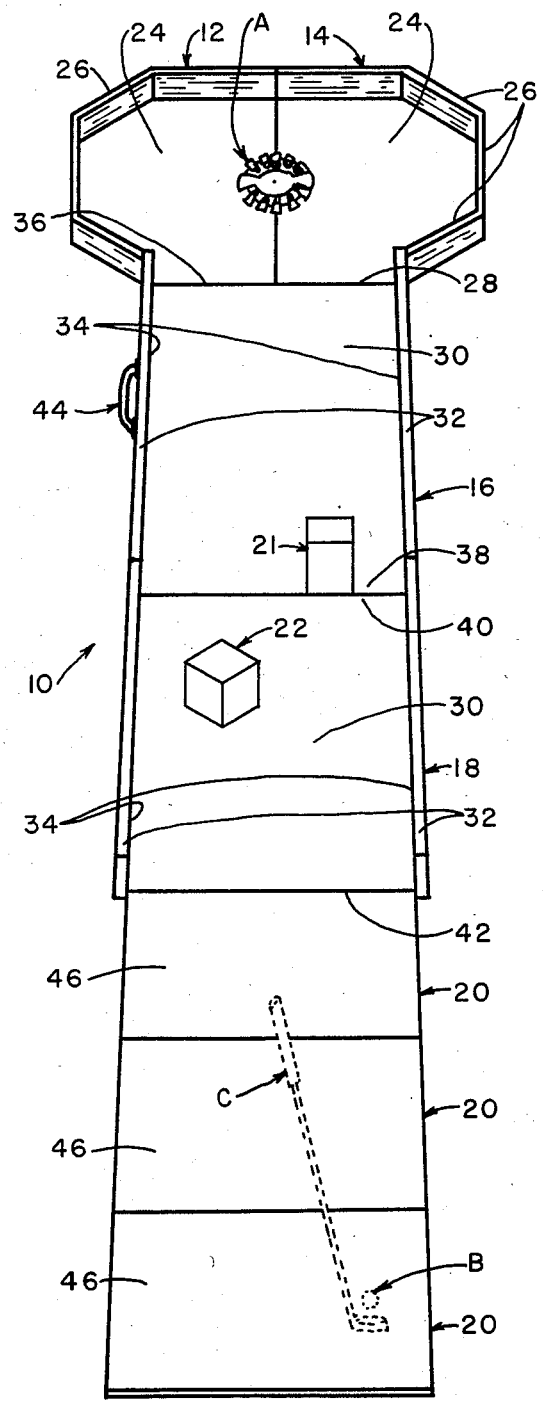
FIG. 1 is a perspective view of the preferred embodiment of the present invention assembled and ready for play.

Referring to the drawings, more particularly by reference numbers, wherein like numbers refer to like parts, FIG. 1 shows the portable golf game 10 constructed according to the teachings of the present invention. The portable golf game 10 has greens portions 12 and 14, obstacle placement portions 16 and 18 and fairway portions 20 which portions are shown more clearly in FIG. 2. The game also includes obstacle members 21 and 22 for placement on the obstacle portions 16 and 18. When assembled for play as shown in FIG. 1, the greens portions have placed thereon a golf ball receiving cup A, which may be placed anywhere on the greens portion. The game 10 is to be played using a standard golf ball B and a standard golf club, such as a putter C.

The greens area comprises the greens segments 12 and 14 having a planar playing surface 24 which is preferably covered by a fiberous material such as carpet or artificial turf. At the edges of the greens segments 12 and 14 is a substantially normal extending wall 26. The wall 26 extends around the perimeter of the greens area except for an opening 28 that is positioned adjacent the obstacle placement segment 16 when the present device is assembled for play. In one embodiment, the wall 26 is formed of a plurality of wall segments joined in angular relation. The wall is to extend sufficiently above the playing surface 24 to restrain a golf ball thereon. The greens area may be of any configuration such as elliptical, rectangular or any other configuration and is preferably an irregular polygon so that a ball striking the wall 26 will rebound in an unpredictable manner thus making the game more exciting.

A ball receiving cup A is placed on the playing surface 24 of the greens area. It may be moved to any location within the walls 26 in order to change the difficulty of the game. Placing the cup A near the center of the greens area makes the hole easier to play than if the cup is placed away from the center. Many different types of ball receiving cups, such as cups commonly available for putting practice, may be used with the present game. The ball receiving cup A depicted in FIG. 1 includes hingedly attached tip-up tabs which allow a golf ball to pass thereover and thereafter return to their original position to retain the ball in the cup. Other types of ball receiving cups are contemplated to be used with the present invention.

The obstacle placement segments 16 and 18 also include planar playing surfaces 30 covered with a fiberous material, as described above. Wall members 32 are located at opposite edges 34 of the playing surface 30 and extend substantially normal thereto. The walls 32, thus, run along the sides 34 of the playing surface 30 and define open ends 36, 38, 40 and 42, respectively, of the placement segments 16 and 18. When assembled for play the one open end 36 of placement segment 16 is placed in registration with the opening 28 of the greens area and the one open end 40 of the other placement segment 18 is placed in registration with the second open end 38 of the placement segment 16. This placement enables a golf ball to pass through the placement segments 16 and 18 and onto the greens area. The walls may be of any desired height above the playing surfaces. The walls 32 preferably extend further above the playing surface 30 than the wall members 26 of the greens segments 12 and 14 extend above the playing surface 24. Thus, when the obstacle placement portions 16 and 18 are joined to form a carrying container, as will be described hereinafter, the other game pieces, including the greens segments 12 and 14, will fit therein. One wall member 32 has mounted thereon a handle 44 which is used to carry the present game 10 when it is assembled into a compact unit for carrying and storage. The handle 44 is affixed to the wall 32 opposite the side adjoining the playing surface 30 so that it does not interfere with play. The playing surface 30 may have marked thereon numbered areas, such as the predetermined numbered areas, described more fully in conjunction with FIG. 3, for placement of the obstacle members 21 and 22 at such predetermined locations. The obstacle members 21 and 22 may be either placed on the playing surface 30 at the predetermined marked locations or at any other location on the obstacle placement segments 16 and 18.

The obstacle members 21 and 22 are relatively hard, geometrically shaped objects so that a golf ball striking them will rebound somewhat. They are formed of a durable substance, such as wood, metal, rigid plastic or other relatively durable material so as to resist breaking and chipping when struck by a golf ball. The obstacle members are relatively heavy to resist movement when struck by the golf ball. However, some movement of the obstacles when struck is expected and is incorporated into the playing of the game. In the embodiment depicted in FIG. 1, the obstacle members 21 and 22 are cube shaped, although it is foreseen that obstacle members of other shapes may be used with the present invention as well. The weight of the obstacle members 21 and 22 may vary and will depend on the method of attachment. Preferably the obstacle members will weigh enough to remain relatively fixed in place. However, attaching means may be used such as magnets, Velcro strips, and other means for retaining the obstacle members in place while making it easy to move them.

The fairway segments 20 are planar elements having a playing surface 46 which may be covered by a fiberous material as described above. A first fairway segment 20 is placed adjacent to the open end of the obstacle placement segment 18 and additional fairway segments 20 are placed in line abutting the first segment to form an extended fairway. In an alternate embodiment, the fairway may be formed of one extended section of playing surface material which would be rolled for storage and unrolled for use.

Figure 3:
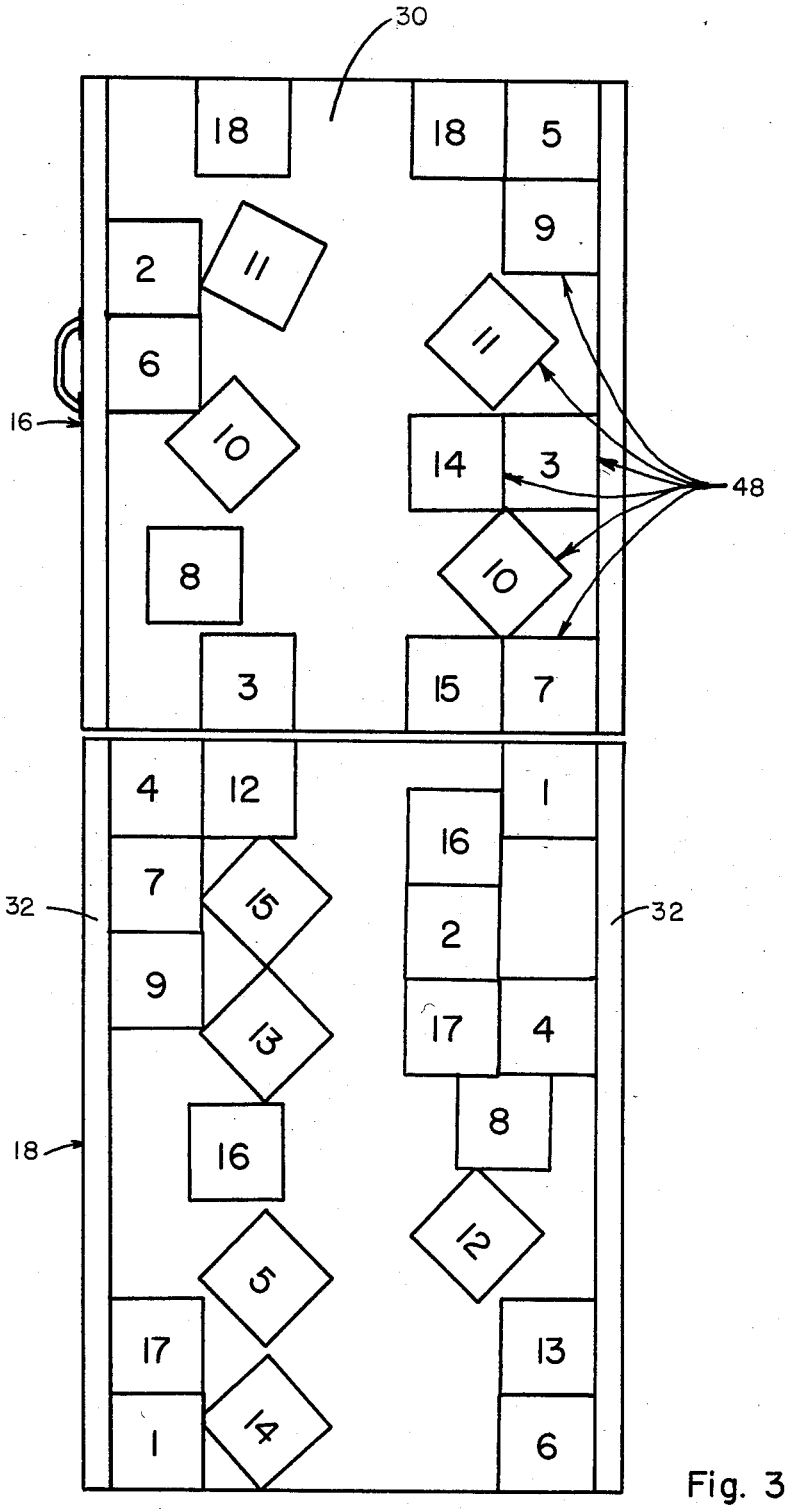
FIG. 3 is a top plan view of the obstacle placement segments of the present invention showing the marked locations thereon.

FIG. 3 shows the arrangement of obstacle member locations 48 marked on the playing surface 30 of the obstacle placement segments 16 and 18 in the preferred embodiment. The obstacle locations 48 are numbered from "1" through "18", inclusive, corresponding to holes "1" through "18" in a game of golf. The obstacle locations 48 of the depicted embodiment have been chosen to reflect an increasing difficulty of play as the game progresses and the number of the hole being played increases. Thus, hole "18" is more difficult than hole "9". The obstacle locations 48 are shown as squares in FIG. 3 to correspond to the cube shaped obstacles 21 and 22 but other shaped locations may also be used for other shaped obstacles. Although the indicated obstacle locations 48 have yielded satisfactory results, many other obstacle locations are also contemplated and are deemed covered by the present invention.

Figures 4, 5:
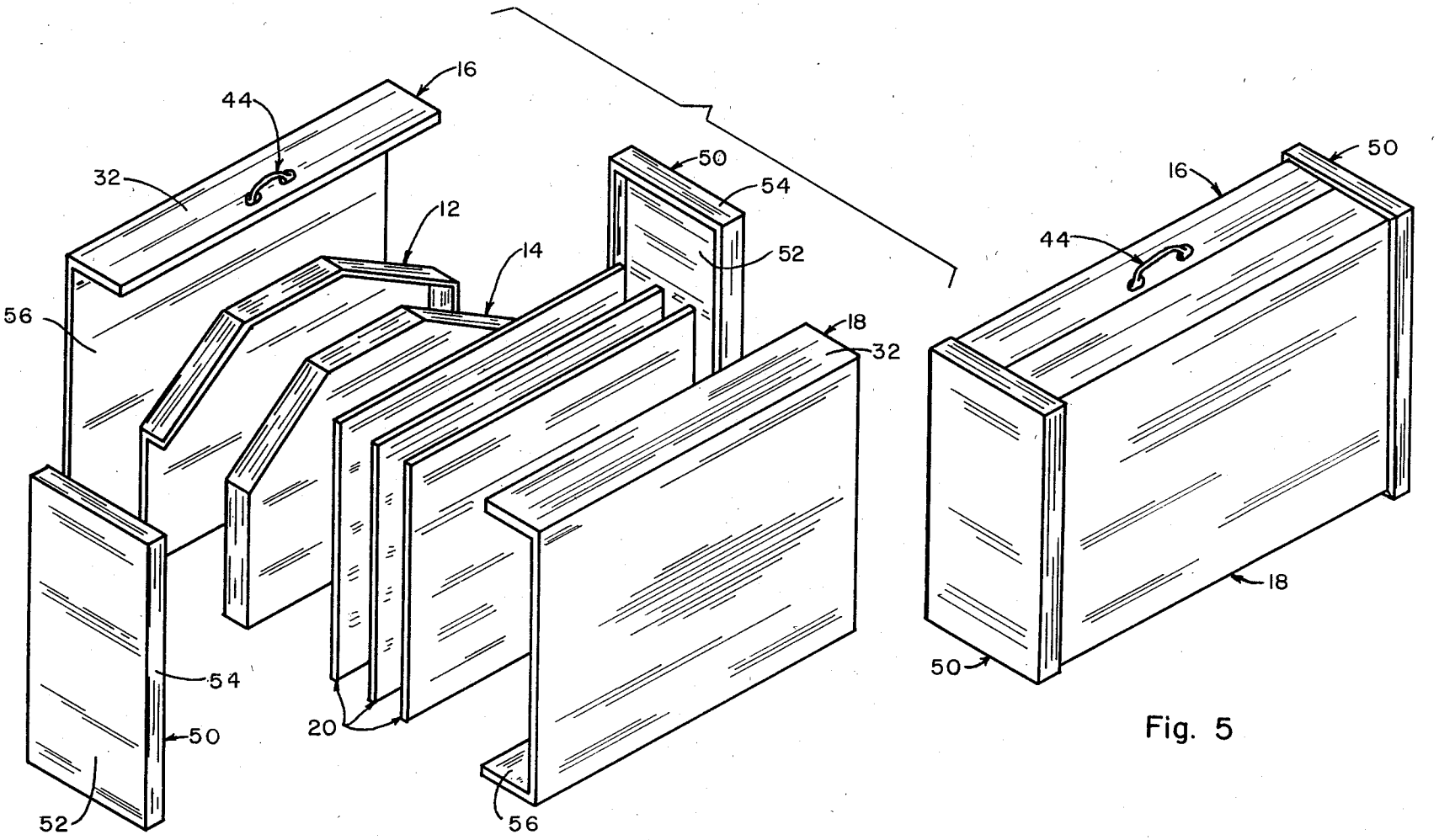
FIG. 4 is an exploded perspective view of the device of FIG. 1 shown assembled into a compact container for storage or transportation.
FIG. 5 is a perspective view of the device of FIG. 1 packed into a compact container formed of the obstacle placement segments.

FIG. 4 is an exploded view of the present device showing how the game elements may be packaged into a compact carrying case and FIG. 5 shows the present device assembled for transportation and storage. The obstacle segments 16 and 18 are selectively joinable to form a container for the game of the present invention when the segments 16 and 18 are collocated with the wall members 32 extending toward each other so as to engage each other. The other game elements, including the greens segments 12 and 14, the fairway segments 20, the obstacle members 21 and 22 and the ball receiving cup A, are placed between opposite walls 30 of one obstacle placement segment 16 or 18 and the other obstacle placement segment is placed over the other game elements to form a container. The container may also have end cap portions 50 which secure the obstacle segments 16 and 18 together and prevent the other game elements from falling out of the container. The end cap portions 50 in one embodiment are formed of a planar portion 52 with normally extending edge members 54 therearound. The edge members 54 slip over the open ends 56 of the obstacle placement segments 16 and 18 to hold them together and form a compact container as shown in FIG. 5. It can be seen that once the obstacle segments 16 and 18 are joined together with the greens segments 12 and 14 and the fairway segments 20 inside, and the end caps 50 are placed over the ends of the obstacle members that a compact container is formed which may be easily carried by the carrying handle 44.

Figure 2:
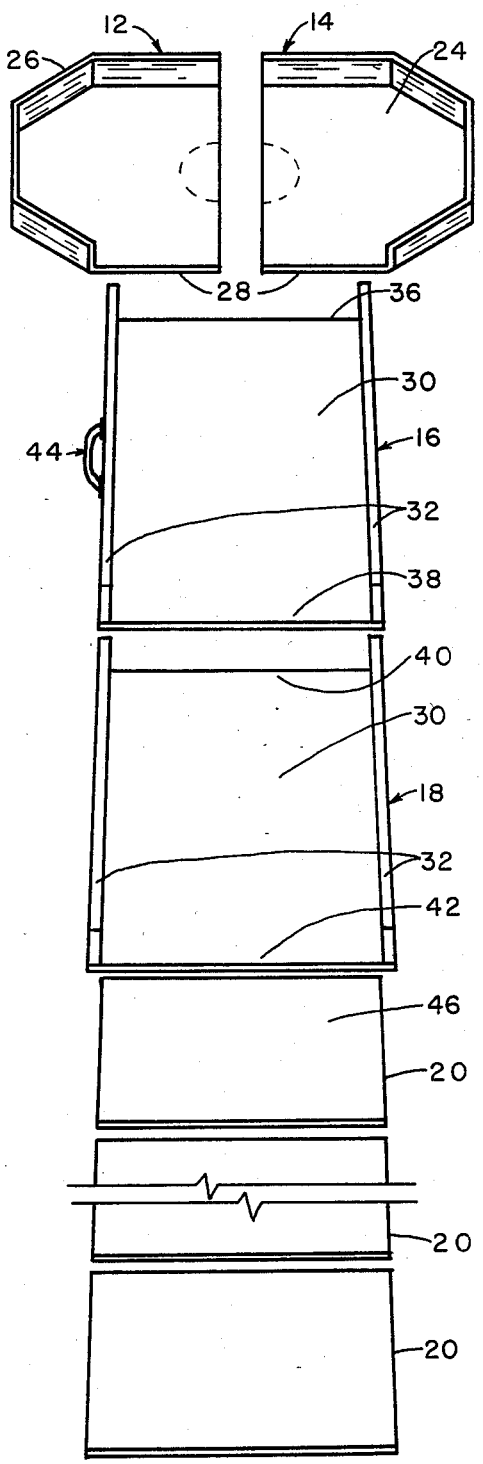
FIG. 2 is an exploded perspective view of the device of FIG. 1.

To assemble the present game for playing, the individual elements, shown separatly in the exploded view of FIG. 2, are placed abutting each other as in FIG. 1 so that the greens segments 12 and 14 form a greens area with a wall 26 extending part of the way therearound. The first open end 36 of the obstacle segment 16 is placed to abut the opening 28 of greens area and the first open end 40 of the obstacle segment 18 is placed abutting the second open end 38 of the segment 16 so that a walled enclosure is formed with an opening 42 at one end thereof. The fairway segments 20 are placed abutting the second open end 42 of the obstacle segment 18 to form a line of way for a rolling golf ball. At least one of the obstacle members 21 and 22 is placed on the obstacle segments 16 and 18 and the golf ball B placed on some part of the fairway readying the course for play.

With golf club in hand, the first player addresses the ball in the traditional manner. He strikes it, attempting to roll or putt the ball down the fairway, past the obstacle and into the cup A. If successful on his first attempt, this first player records his score and allows the second player to attempt to putt the ball into the cup. If the first player fails in his attempt with the first stroke, he is then allowed further strokes in his attempt to putt the ball into the cup. He is to play the ball from where it lies as a result of the previous stroke except when the ball comes to rest near a wall or an obstacle, in which case the player is allowed to move the ball one club head length from the wall or obstacle. He may not, however, move the ball toward the cup as he moves the ball away from the obstruction. It is expected that the obstacle members 21 and 22 may be moved about somewhat when they are struck by the ball. They are to remain as so moved until the "hole" being played is over and the player gets the ball into the cup. The obstacles are then moved by a player back to their original positions or to new positions in preparation for the next hole.

Once the first player has finished the "hole", the second player takes his turn and so on until each player has had an opportunity to play that "hole". The obstacle member is then moved to a new location thereby forming the next "hole" to be played. This continues with each player playing a "hole" and recording his score for that hole, which score is the number of strokes it takes a player to get the golf ball into the cup for each hole. A game, which preferably consists of eighteen holes, is won by the player with the lowest total score, the scores for each hole played being added together to form a total. Alternatively, the game may be played with more than one ball in play and with the players alternating as in a game of field golf.

The present game may also be played in much the same way by only one person. After the individual player has played a hole, he moves the obstacle to the location for the next hole. In this way an individual can challenge himself to improve his golf game and putting skills.

The materials of construction may include any of the well known construction materials. Preferably, light weight materials are used to make the game more easily transportable. For example, the base segments and wall portions may be made from foamed or non-foamed rigid plastics such as polycarbonates, polyurethanes, polyvinyl chlorides, polyamides, polyolefins and styrene-butadiene copolymers. Also, wood products such as cut boards, pressed chipboard, plywood and other wood products may be used. Sheet metal is also satisfactory.

The playing surface is intended to simulate grass and may be made from carpeting or a synthetic grass surface. A particularly useful surface is Astroturf synthetic grass manufactured and marketed by Monsanto Company, St. Louis, Mo.

The cup may also be made from a variety of materials such as plastic, wood or metal. Also, it may vary in size and difficulty of retaining the ball. A preferred embodiment is made from plastic, has depressable leaves around much of the periphery with at least one straight-in run.

Thus there has been shown and described a novel device in a portable golf game, which device fulfills all the objects and advantages sought therefore. Many changes, modifications, variations and other uses and applications of the present construction will, however, become apparent to those skilled in the art after considering this specification and the accompanying drawings. All such changes, modifications, variations and other uses and applications which do not depart from the spirit and scope of the invention are deemed to be covered by the invention which is limited only by the the claims which follow.

What is claimed is:

1. A portable game apparatus for playing one or more holes of golf, the object of each hole of golf being to project a standard golf ball into a ball receiving cup with a standard golf club in as few strokes as possible, said game apparatus comprising a fairway segment member defining a playing surface including a tee surface from which the golf ball can be projected over said fairway segment member, a first intermediate segment member having wall members extending upwardly on opposite sides thereof in substantially parallel relationship with each other, the space between said wall members defining a playing surface adapted to abut said fairway segment member to provide a continuous playing surface when one end thereof is placed in abutting relationship with said first segment member a second intermediate segment member having wall members extending upwardly on opposite sides thereof in substantially parallel relationship with each other and having a playing surface defined by the space between said wall members, said second intermediate segment member having one end thereof adapted to be placed in abutting relationship with the other end of said first intermediate segment member such that the corresponding surfaces are in alignment, said first and second intermediate segment members being adaptable to form a container for said game apparatus, a greens area having first and second greens segment members, each of said greens segment members having opposite end portions and opposite side portions, each of said greens segment members having wall members extending upwardly on one of said side portions and one of said end portions, an unwalled portion extending along the other end portion and the other side portion of each of said greens segment members, said greens area being formed by placing said greens segment members in abutting relationship with the unwalled side portion of one of said greens segment members abutting the unwalled side portion of the other of said greens segment members and with the wall members of each of said greens segment members forming a side wall portion along the periphery of the greens area, said side wall portion having an opening defined by the unwalled end portion of each of said greens segment members, said greens area being adapted to be placed in abutting relationship with the other end of said second intermediate segment member such that the corresponding surfaces are in alignment to provide a continuous playing surface, a movable ball receiving cup for placement on said greens area, said cup having means thereon for retaining a golf ball which has been projected thereinto, one or more obstacle members adaptable for obstructing the movement of a projected golf ball when placed on said continuous playing surface, indicia disposed on said intermediate segment members for identifying locations upon which at least one of said obstacles may be placed, each indicium corresponding to one hole of the golf game whereby the positioning of the one or more obstacle members on said continuous playing surface is predetermined by the indicium for each particular hole of the golf game.

* * * * *